United States Patent [19]

Honig et al.

[11] Patent Number: 4,718,321

[45] **Date of Patent: * Jan. 12, 1988**

[54] REPETITIVE RESONANT RAILGUN POWER SUPPLY

[75] Inventors: Emanuel M. Honig; William C. Nunnally, both of Los Alamos, N. Mex.

[73] Assignee: The United States of America as represented by the United States Department of Energy, Washington, D.C.

[ * ] Notice: The portion of the term of this patent subsequent to Jan. 12, 2005 has been disclaimed.

[21] Appl. No.: 746,478

[22] Filed: Jun. 19, 1985

[51] Int. Cl.[4] ..... F41F 1/02

[52] U.S. Cl. ..... 89/8; 124/3; 307/106; 307/108

[58] Field of Search ..... 89/8; 124/3; 310/11-14; 318/135; 307/314, 282, 252 T, 252 UA, 252 J, 415, 416, 106, 107, 108; 328/67, 65, 33; 323/208, 209, 232, 233; 361/2, 8, 9; 372/38, 87

[56] References Cited

U.S. PATENT DOCUMENTS

| | | | |
|---|---|---|---|
| 3,279,320 | 10/1966 | Rosebrock | 89/8 |
| 3,308,342 | 3/1967 | Coradeschi | 307/282 X |
| 4,343,223 | 8/1982 | Hawk et al. | 89/8 |
| 4,406,952 | 9/1983 | Molen et al. | 328/67 X |
| 4,433,607 | 2/1984 | Kemeny | 89/8 |
| 4,473,875 | 9/1984 | Parsons et al. | 307/106 X |
| 4,544,874 | 10/1985 | Weldon et al. | 322/10 |
| 4,572,964 | 2/1986 | Honig | 89/8 X |

OTHER PUBLICATIONS

"The Radio Amateur's Handbook", American Radio Relay League, Newington, Conn., 1973, pp. 41-45.

H. F. Storm, "Magnetic Amplifiers", John Wiley & Sons, Inc., New York, 1959, pp. 68-79.

G. T. Coate et al., "High-Power Semiconductor-Magnetic Pulse Generator", Research Monograph No. 39, The MIT Press, Cambridge Mass., 1966, pp. 8-21.

Emanuel M. Honig, "Progress in Developing Repetitive Pulse Systems Utilizing Inductive Energy Storage," Los Alamos National Laboratory report LA-U-R-83-1584 (Jun. 1983).

Emanuel M. Honig, "A 240-KA Switch with Potential Application in Electromagnetic Launch Systems," LA-UR-2710 (Oct. 1983).

Emanuel M. Honig, "Repetitive Opening Switches," LA-UR-83-2926 (Sep. 1983).

R. A. Marshall, "Railgun Overview," in Proceedings of the Impact Fusion Workshop, Compiled by A. T. Peaslee, Jr., Los Alamos National report LA-8000-C (Aug. 1979).

Thomas A. Carroll, Pritindra Chowdhuri, and John Marshall, "An Electromechanical Capacitor for Energy Transfer," Los Alamos National Laboratory report LA-UR-83-1598, (May 1981).

Emanuel M. Honig, "Repetitive Energy Transfers from an Inductive Energy Store," Los Alamos National Laboratory report LA-10238-T (Aug. 1984).

*Primary Examiner*—Stephen C. Bentley

*Attorney, Agent, or Firm*—Leonard C. Brenner; Paul D. Gaetjens; Judson R. Hightower

[57] ABSTRACT

A repetitive resonant railgun power supply provides energy for repetitively propelling projectiles from a pair of parallel rails. The supply comprises an energy storage capacitor, a storage inductor to form a resonant circuit with the energy storage capacitor and a magnetic switch to transfer energy between the resonant circuit and the pair of parallel rails for the propelling of projectiles.

4 Claims, 4 Drawing Figures

REPETITIVE RESONANT RAILGUN POWER SUPPLY

BACKGROUND OF THE INVENTION

The present invention relates generally to a high-power pulsing apparatus and, more particularly, to a repetitive resonant railgun power supply. This invention is the result of a contract with the Department of Energy (Contract No. W-7405-ENG-36).

Many applications require power in the form of a train of high-power pulses. Included among these applications are high-repetition-rate particle accelerators and lasers, pulsed microwave generators, high-power high-resolution radar, induction heating systems and electromagnetic projectile launchers.

Electromagnetic projectile launchers such as railguns are under consideration for space and ground defensive weapons systems because they can accelerate projectiles to velocities much greater than conventional chemical guns. Railguns have demonstrated velocities of 10 km/s while chemical or gas guns obtain maximum velocities of 3 km/s. A projectile is accelerated in a railgun by a large current which travels along one rail to the projectile where it is conducted to the opposite rail through the projectile or a metallic plasma and returns to the current source. Projectile acceleration is due to the interaction of the large magnetic field between the rails and the current flowing through the projectile end and is proportional to the square of the rail current. Because the acceleration falls off rapidly if the current decreases, the minimum acceleration time and the shortest barrel or rail length is obtained when a constant current is used to accelerate the projectile. Railguns require megampere level currents to accelerate projectiles with masses of interest.

In order to provide a relatively constant current to conventional railguns, a common inductive energy storage system is used in which the rail electrodes are in parallel with an opening switch. The inductor is charged to the megampere level current desired through the closed switch. The switch is opened by increasing the impedance of the current path which generates a large voltage and transfers the current to the rail electrodes. A conventional opening switch must absorb a large amount of energy and then hold off the large transient voltage generated by the increase in resistance. For these reasons, conventional inductive energy storage and opening switch systems have been operated only in single pulse and very low voltage systems at megampere current levels because the opening switch is difficult to build and operate.

It is therefore an object of the present invention to provide a high-power repetitive pulsing system capable of continuous operation.

It is another object of the present invention to provide a high-power repetitive pulsing system wherein the opening switch function is performed with negligible energy loss.

It is yet another object of the present invention to provide a repetitive resonant railgun power supply.

SUMMARY OF THE INVENTION

To achieve the foregoing and other objects, and in accordance with the purpose of the present invention, as embodied and broadly described herein, the repetitive resonant railgun power supply of the present invention includes a resonant tank circuit comprising a storage inductor and a storage capacitor. In such a circuit the current in the inductor is set at a peak value twice in each cycle and the inductor functions at those times as a constant current inductive source.

When the resonant tank storage system is used as an electromagnetic projectile launcher power supply, it makes repetitive operation possible when the resonant frequency is chosen equal to half of the desired projectile repetition rate and projectiles are loaded every half cycle or at multiples of half cycles. While the basic resonant tank circuit storage system is applicable to many repetitive, high power systems, only the needs of powering a repetitive railgun system will be discussed for illustrative purposes.

In the resonant cycle, just past peak current, a projectile is inserted between the rails of a railgun and the current entering the storage capacitor is transferred to the railgun by using a magnetic switch. At peak inductor current, the magnetic switch is saturated and the capacitor voltage is zero and charging to a positive value. In order to transfer current from the capacitor-magnetic switch branch of the circuit to the rail-projectile branch, the capacitor is allowed to charge until its voltage is slightly larger than the maximum voltage expected to be seen across the rails during acceleration. The projectile is then injected into the gun breech completing the rail-projectile branch of the circuit. The low rail-projectile impedance and the voltage on the capacitor causes the capacitor current to drop to zero, unsaturating the magnetic switch and increasing the current in the gun to the storage coil value. In the unsaturated state, the magnetic switch impedance is much larger than the gun impedance so that most of the coil current flows into the rail-projectile branch and the capacitor-inductor branch is essentially disconnected from the circuit.

Projectile acceleration is terminated when the projectile leaves the ends of the rails. At the end of projectile acceleration, the magnetic switch is nearly saturated in the forward direction. As the projectile leaves the rails, the impedance of the rail-projectile branch increases rapidly due to the increasing inductance of the expanding arc behind the projectile. The increase in gun voltage above the residual capacitive voltage reverses the polarity of the voltage across the magnetic switch and saturates the magnetic switch in the initial direction so that the magnetic switch impedance is low and the coil current again flows into the capacitor, restoring resonant circuit operation. As the current is transferred to the low impedance capacitor-magnetic switch branch, the rail arc extinguishes. A cycle is completed and the next ready to begin.

An alternative mode of operation after the projectile leaves the barrel is to close a switch across the muzzle and utilize the energy recovery circuit described in U.S. Pat. No. 4,572,964, issued Feb. 25, 1986, filed on Sept. 28, 1984 and entitled "Counterpulse Railgun Energy Recovery Circuit."

An advantage of the present invention is that continuous operation of a railgun system is made possible through the naturally repetitive operation of an inductive current source.

Another advantage of the present invention is that negligible energy is lost in the switching process and the switch itself is not subject to erosion.

Still another advantage of the present invention is that the railgun projectile is accelerated by a constant current source.

Still yet another advantage of the present invention is that standby operation is possible.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate the embodiment of the present invention and, together with the description, serve to explain the principles of the invention. In the drawings.

DETAILED DESCRIPTION OF THE PREFERRED EMBODIMENT

Figure 1:
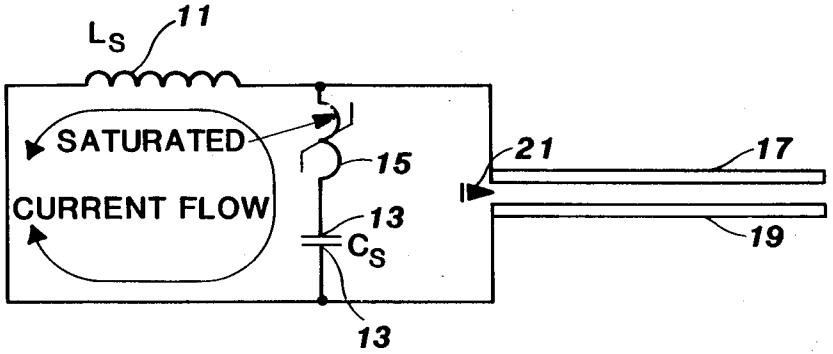
FIG. 1 is a schematic of the repetitive resonant railgun power supply of the present invention.

The present invention may be implemented with a storage inductor 11, a storage capacitor 13, a saturable magnetic switch 15, and a railgun with parallel rails 17 and 19 for accelerating a projectile 21, see FIG. 1. The energy for projectile acceleration is stored in a resonant tank circuit comprising the storage inductor 11, the storage capacitor 13 and the saturable magnetic switch 15 in its saturated state. The current $I_m$ in the storage inductor 11 is at a peak value twice in each cycle and available as a constant current inductive source. The resonant tank storage circuit makes repetitive operation possible when the resonant frequency is chosen equal to half of the desired projectile 21 repetition rate and projectiles are loaded every half cycle or at multiples of half cycles. While the present invention is applicable to many repetitive, high power systems, only the railgun embodiment will be detailed below for illustrative purposes.

Figure 2:
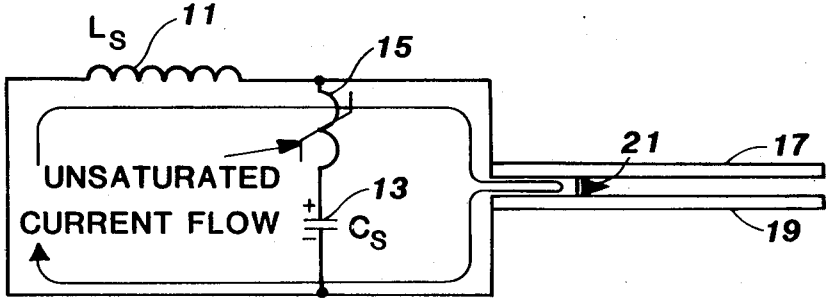
FIG. 2 illustrates the operation of the repetitive resonant railgun power supply of FIG. 1 during projectile acceleration.
Figure 3:
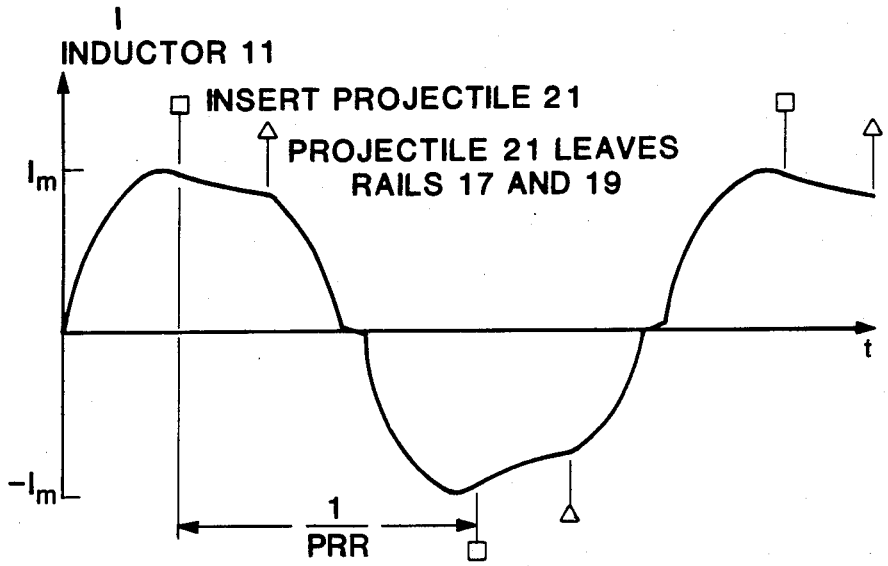
FIG. 3 is a waveform diagram for the current in the storage inductor of the repetitive resonant railgun power supply of FIG. 1.
Figure 4:
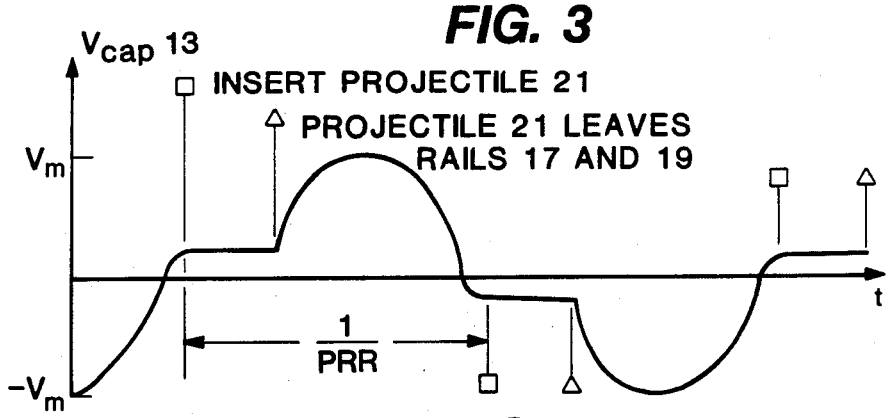
FIG. 4 is a waveform diagram for the voltage across the storage capacitor of the repetitive resonant railgun power supply of FIG. 1.

At a specific point in the resonant cycle, just past peak current, the projectile 21 is inserted between the rails 17 and 19 and the current entering the storage capacitor 13 is transferred to the rails 17 and 19 by using the magnetic switch 15. As the capacitor 13 attempts to discharge through the initially low-impedance railgun load, the magnetic switch 15 current goes through zero causing the magnetic switch 15 to unsaturate or "open." With the magnetic switch 15 in its unsaturated state and the projectile 21 inserted between rails 17 and 19, the current path is switched from the storage inductor 11, magnetic switch 15 and storage capacitor 13 path shown in FIG. 1 to the storage inductor 11, rails 17 and 19 and projectile 21 path shown in FIG. 2. The current variation through the storage inductor 11 and the voltage variation across the storage capacitor 13 during operation is shown in FIGS. 3 and 4 respectively.

At peak inductor 11 current prior to projectile 21 insertion, the magnetic switch 15 is saturated and the storage capacitor 13 voltage is zero and charging to a positive value. In order to transfer current from the capacitor-switch circuit branch, the storage capacitor 11 is allowed to charge until its voltage is slightly larger than the maximum voltage expected to be seen across rails 17 and 19 during acceleration. The projectile 21 is then injected into the rails 17 and 19 completing the rail-projectile branch of the circuit, see FIG. 2. The low rail-projectile impedance and the voltage on the storage capacitor 13 causes the storage capacitor 13 current to drop to zero, unsaturating the magnetic switch 15 and increasing the current in the rails 17 and 19 to the storage inductor 11 value. In the unsaturated state, the magnetic switch 15 impedance is much larger than the impedance of the rails 17 and 19 so that most of the storage inductor 11 current flows into the rail-projectile branch and the capacitor-inductor branch is essentially disconnected from the circuit. Negligible energy has been lost in the switching process, the magnetic switch 15 is not subject to erosion, and the projectile 21 is accelerated by a substantially constant current source.

Projectile acceleration is terminated when the projectile 21 leaves the ends of the rails 17 and 19. The volt-second capacity of the magnetic switch 15 is designed to be equal to the integral of the difference between the capacitor 13 voltage and the increasing railgun voltage over the acceleration time. At the end of projectile 21 acceleration, the magnetic switch 15 is nearly saturated in the forward direction. As the projectile 21 leaves the rails 17 and 19, the impedance of the rail-projectile branch increases rapidly due to the increasing inductance of the expanding arc behind the projectile 21. When the increasing railgun voltage exceeds the residual capacitor 11 voltage, the polarity of the voltage across the magnetic switch 15 reverses and the magnetic switch 15 saturates in the initial direction. With the magnetic switch 15 impedance low, the storage inductor 11 current again flows into the storage capacitor 14, restoring resonant circuit operation. As the current is transferred to the low impedance capacitor-magnetic switch branch, the rail arc extinguishes.

The inductive energy stored between the rails 17 and 19 at the end of projectile 21 acceleration can be recovered with resonant recovery circuits such as disclosed in U.S. patent application Ser. No. 655,593 and U.S. Pat. No. 4,572,964, issued Feb. 25, 1986.

At conventional railgun specifications, the storage capacitor 13 needs to withstand voltages of about 20 kV and have a capacitance of about 0.2 F. The storage capacitor 13 needs to store about 40 MJ at a maximum current of 2 MA and series inductance of 0.1 $\mu$H. In order to store the large amount of energy, a mechanical capacitor such as a homopolar generator is desired. However, the capacitance requirement is much lower than possible with conventional homopolars while the voltage requirements are much larger than present day homopolars. The conflict in requirements and available homopolar specifications can be resolved with a low leakage inductance, high current, voltage step up transformer which is used to match the homopolar capacitance and voltage to the railgun system by stepping up the voltage and decreasing the effective capacitance. In addition, multiple primary windings on the transformer can each be driven by a separate homopolar generator so that smaller homopolars and rotational energy sources may be combined. Further details on an electromechanical capacitor for energy transfer is given by T. Carroll, P. Chowdhuri, and J. Marshall in LA-UR 83-1598, Los Alamos National Laboratory. Information contained therein was presented at the 4th IEEE Pulsed Power Conference, June 6–8, 1983 in Albuquerque, N. Mex. and published in IEEE Pub. No. 83CH1908-3, pp. 435–438.

An alternative method for providing the storage capacitance required is to use a double layer electrochemical capacitor. Capacitors of this type are presently being used for backup power in computers. The energy density of presently available double layer capacitors is approximately 1–2 J per $cm^3$. In order to store 40 MJ, a volume of about 40–20 $m^3$ is required which corresponds to a cubic structure of about 3–4 m on a side. The voltage level of each double layer cell is only about 1 V with a present thickness of 3 mm/volt. The cell thickness can be reduced to less than 0.3 mm/volt because the active region is a membrane with a thickness of less than 0.025 mm. Thus the stack height required to obtain the required 20 KV is about 6 m. The voltage gradient is only 30 V/cm and the dimensions are realistic in terms of the proposed application.

Although the double layer capacitor is practical now for many applications, efforts are continuing to make it a preferred anergy storage device in even more critical applications. For example, efforts are being directed to increase the energy density of double layer capacitors to the 10–20 J/$cm^3$ level so that this system can be a factor of ten smaller. Additional efforts are being conducted to increase the voltage level of the individual electrochemical cell from 1 V to several volts so that the required stack height can be reduced to 1 or 2 m. Thus double layer capacitors can be used for the subject application today using present technology with significant improvements expected in the future.

The energy for acceleration of each projectile is transferred to the circuit as shaft torque through the rotating capacitor with a prime power source. Approximately three times the projectile energy is supplied to the system plus the resistive losses between projectiles. Thus, the repetitive resonant railgun power supply of the present invention can operate continuously, supplied only by a source of multiple sources of torque.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A repetitive railgun power supply for accelerating a projectile at predetermined intervals, comprising:

a pair of parallel rails for guiding said projectile and having an inductive load impedance;

a storage capacitor for providing energy to propel said projectile along said pair of parallel rails, said storage capacitor having a first end connected to one rail in said pair of parallel rails and a second end;

a storage inductor for providing a circuit with said storage capacitor resonant at a frequency determined by said predetermined intervals for accelerating said projectiles, said storage inductor having a first end connected to the other rail in said pair of parallel rails and a second end connected to said first end of said storage capacitor; and a saturable magnetic switch having a low impedance saturated state relative to said inductive load impedance for maintaining energy flow in said resonant circuit formed by said storage capacitor and said storage inductor and having a high impedance unsaturated state relative to said inductive load impedance for transferring energy flow to said pair of parallel rails, said magnetic switch having a first end connected to said first end of said storage inductor and a second end connected to said second end of said storage capacitor and having a volt-second capacity effective to maintain said high impedance state during said accelerating said projectile and to switch to said low impedance state when an arc is formed between said rails as said projectile exits said rails.

2. The repetitive resonant railgun power supply according to claim 1 wherein said storage capacitor includes a mechanical capacitor.

3. The repetitive resonant railgun power supply according to claim 2 wherein said mechanical capacitor is a homopolar generator.

4. The repetitive resonant railgun power supply according to claim 1 wherein said magnetic switch has a volt-second capacity functionally related to an integral of a voltage difference between a voltage across said capacitor and a voltage across said pair of rails during an acceleration time for said projectile.

* * * * *